United States Patent [19]

Mazzolla

[11] 3,961,430

[45] June 8, 1976

[54] PNEUMATIC PAD AND ROLL COVER FOR IRONING ROLLS ON INDUSTRIAL IRONERS

[76] Inventor: Dan D. Mazzolla, 2464 Raleigh Drive, York, Pa. 17402

[22] Filed: Mar. 7, 1975

[21] Appl. No.: 556,100

Related U.S. Application Data

[63] Continuation-in-part of Ser. No. 487,020, July 10, 1974, abandoned.

[52] U.S. Cl. ..... 38/66

[51] Int. Cl.[2] ..... D06F 71/36

[58] Field of Search ..... 38/66, 140

[56] References Cited

UNITED STATES PATENTS

| | | | |
|---|---|---|---|
| 2,327,492 | 8/1943 | Braun | 38/66 X |
| 3,057,179 | 10/1962 | Willingham | 38/66 |
| 3,099,886 | 8/1963 | Warchol | 38/66 |

*Primary Examiner*—Patrick D. Lawson

*Attorney, Agent, or Firm*—C. Hercus Just; Samuel M. Learned, Jr.

[57] ABSTRACT

An inflatable backup pad adapted to be mounted upon the ironer rolls of an industrial type ironer and having opposite ends detachable connectable, in combination with a roll cover adapted to surround the exterior surface of said pad and the ends of said cover also being detachably connected to define the outer operative surface of the ironer roll, said cover being distended to its full circumference when said pad is inflated and thereby cause said pad to frictionally engage both the ironer roll and said cover to prevent appreciable relative movement therebetween.

9 Claims, 10 Drawing Figures

PNEUMATIC PAD AND ROLL COVER FOR IRONING ROLLS ON INDUSTRIAL IRONERS

This application is a continuation-in-part of Ser. No. 487,020 filed July 10, 1974, and now abandoned.

BACKGROUND OF THE INVENTION

Industrial rotatable cylinder ironing machines, as exemplified and discussed in U.S. Pat. No. 3,151,408 to Mazzolla, the instant applicant, have long been utilized in large scale industrial, commercial, and institutional laundry operations for the purpose of ironing bed linens, table cloths, towels, various articles of clothing such as uniforms or other garments, and the like. From the very outset of the use of said machines certain operational problems have been encountered, and over the years various inventors have made and patented improvements for overcoming said problems and thereby make industrial rotatable cylinder ironers more functionally operational and efficient. However, among the aforementioned problems which have existed, and to a certain extent continue to exist, the following situations are set forth:

First is the difficulty in not having a satisfactory resilient or cushioning backup member placed circumferentially around the longitudinal dimension of the ironing cylinder, between the fabric roll cover and said ironing cylinder, so that thickness irregularities in various work pieces which are being ironed, such as seams or buttons on garments, may be accommodated by deflective compensation of the resilient backup member as the work piece passes through the plurality of ironing machine cylinders in compression between said roll cover and the steam chest surface, and not encounter work piece jams or damage within the machine, or in the case of buttons, not result in breakage.

An early invention attempting to overcome the aforementioned difficulty in U.S. Pat. No. 1,478,229, to Horne, dated Dec. 18, 1923, wherein a plurality of spring members were arranged and affixed in a staggered pattern upon the ironing cylinder between said cylinder and a fabric covered metal shell roll cover in order to provide the desired resiliency. However, today, with the development of more durable and versatile materials, the metal shell roll cover backed by a multiplicity of springs has been primarily replaced by compressible padding such as earlier described and also shown and discussed in Mazzolla supra.

Second, with the advent of the use of resilient cushioning pads as backup members between the fabric roll cover and ironing cylinder, another difficulty developed. Since the steam chest temperature in an industrial rotatable cylinder ironer is of the order of 300°F or higher, a considerable amount of steam is released from the water-damp work pieces during the ironing process. Released steam permeates the fabric roll cover, condenses within and saturates the backup pad member, which results in the two additional problems of excess heat loss by means of conductive transmission of steam chest heat through the rotatable cylinder, which causes reduced efficiency of the ironing machine, and a combination of oxide and chemical corrosion of the rotatable cylinder as a result of extended periods of exposure of said cylinder surface to cleaning material residues entrained within the condensed steam which saturates the roll cover backup pad.

Various methods have been devised in attempts to overcome the excess heat loss and ironing machine rotatable cylinder corrosion problems resulting from steam condensation thereon, as well as also minimizing cleaning residue of corrosion effects upon said cylinder from contaminated water saturation of the backup pad, such as comprises the subject matters of U.S. Pat. No. 2,762,111 to Morgan, dated Sept. 11, 1956, and U.S. Pat. No. 2,608,749 to Obitz dated Sept. 2, 1952.

The present invention relates to an impermeable pneumatic backup pad device which is designed to more satisfactorily overcome, in a unique and novel manner, the industrial rotatable cylinder ironing machine problems heretofore discussed.

Although pneumatic devices per se, such as the disclosures in U.S. Pat. No. 3,706,119 to Collet, dated Dec. 19, 1972, and U.S. Pat. No. 3,553,970 to Wiswell, dated Jan. 12, 1971, are known, it will become apparent, as hereinafter set forth and claimed, that the present invention is distinguishable from the disclosures heretofore cited in that the present invention has utility features and use characteristics which provide new and useful advantages and improvements neither taught nor anticipated by such prior art.

SUMMARY OF THE INVENTION

It is the principal object of the present invention to provide a pneumatic backup pad device and an impervious roll cover assembly, both of which are to be employed for installation and use upon the rotatable ironing cylinder members of an industrial ironing machine, the employment of which will provide an easily installed resilient steam-impermeable air-gap insulation barrier means between the steam chest of said machine and the metal surface of said rotatable cylinders, thereby resulting in increased thermal efficiency of said machine due to reduced radiant, convective, and conductive heat losses through said cylinders, and further minimize steam condensate corrosion occuring upon the metal surface of said cylinders which results when said condensate, containing entrained cleaning component residues, is otherwise in constant contact with the metal surface of said cylinders.

It is another object to provide a yeildable pneumatic pad which will enable the ironing of garments and other fabric work pieces having buttons and bulky seams without the danger of breaking buttons or damaging the work piece or roll cover or steam chest contact surface of said machine due to the yieldable characteristics of said pneumatic backup pad.

It is a further object to provide both backup pad roll cover members which may be easily installed by persons not possessed of either special skills or training.

It is also another object of the present invention to provide a long-lasting roll cover and pneumatic backup pad device which are sufficiently durable to withstand the effects of long term exposure to heat and friction, yet in the event of damage, either the roll cover or backup pad device may be easily and simply repaired with a commercially available vulcanized patch or otherwise.

Still another object is to provide a roll cover backup member, which in the deflated state, may be stored in considerably less space than would otherwise be possible if a non-pneumatic resilient backup pad member were employed.

A further object of the present invention is to provide a roll cover backup pad device, which after initial operational inflation, will maintain the initial compressive circumference throughout the entire ironing process.

An additional object is to provide a pneumatic backup device for the cover which, when operatively inflated, will distendedly secure said roll cover, itself, and said ironing machine cylinder in effective compressive frictional retention against the rotational frictional forces while operationally ironing work pieces during rotation of the ironing cylinders relative to the steam chest.

It is still a further object of the present invention to provide a roll cover backup pad device which will preclude the necessity for drilling and tapping holes in the face of said ironing machine cylinders as would otherwise be required in order to attach and secure by means of screws or the like at least most of the backup pad materials currently available.

Details of the foregoing objects and of the invention, as well as other objects thereof, are set forth in the following specification and illustrated in the accompanying drawings comprising a part thereof.

DETAILED DESCRIPTION

Figure 1:
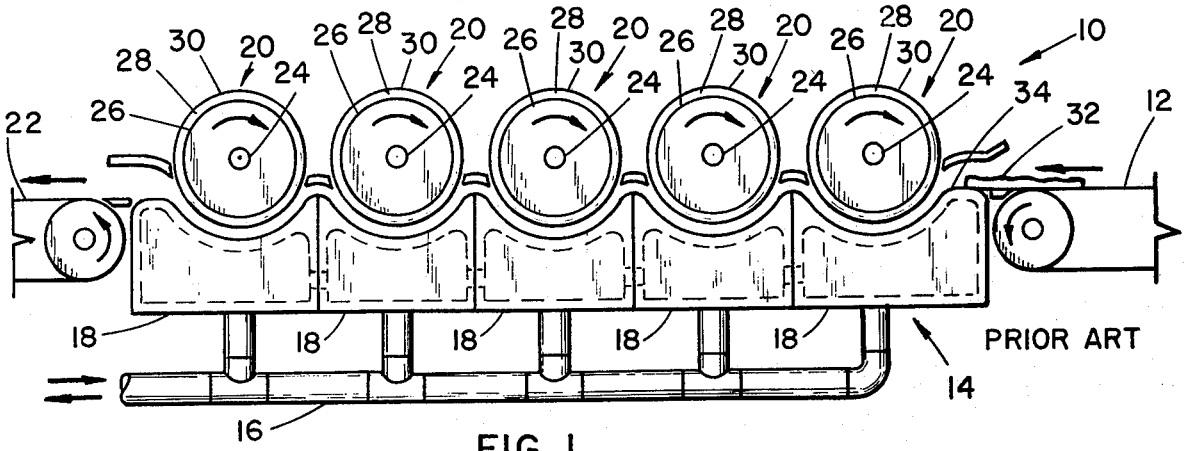
FIG. 1 is a side elevation of an exemplary typical rotatable cylinder type industrial ironing machine.

Referring to FIG. 1, a simplified drawing of a typical rotatable cylinder industrial ironing machine 10 is shown in side elevation, said ironing machine 10 being generally comprised of a work piece input conveyor 12, a steam chest 14 consisting of a steam inlet and condensate return line 16 in addition to a plurality of interconnected steam chest chambers 18, as well as a plurality of clockwise rotating ironing cylinders or rolls 20 and a work piece takeoff conveyor 22. The ironing cylinders or rolls 20, as shown in FIG. 1, are rotatably mounted on a shaft 24 and are rotatably driven in a clockwise direction by conventional gear means, not shown in FIG. 1. Said ironing cylinders or rolls 20 are further comprised of a hollow metal elongated drum 26, a roll cover backup pad member 28, and a fabric roll cover 30.

Generally speaking, a water-damp work piece 32 to be ironed is fed into the ironing machine 10 by means of said input conveyor 12 and thereafter successively is subjected to compressive pressure between said ironing cylinders or rolls 20 and the steam chest apron 34, at temperatures in the vicinity of 300°F radiated from superheated steam circulated through said chambers 18. As the water-damp work piece 32 passes through said ironing machine 10, moisture in said work piece 32 is evaporated in the form of steam as said work piece 32 is pressed and dried by the ironing process. The conventional fabric roll cover 30 generally is at least a somewhat permeable member. Therefore, moisture released in the form of steam from said work piece 32 penetrates said fabric roll cover 30, condenses within and saturates the roll cover backup pad member 28, and, as the steam thus released contains entrained residues from the laundering operation, the chemically contaminated condensate which saturates said roll cover backup pad member 28 is in contiguous contact with the roll drum 26 under temperature and pressure, and tends to corrode the face of said metal roll drum 26. Additionally, the moisture saturated roll cover backup pad member 28 also functions as an absorptive heat reservoir, thereby reducing the thermal efficiency of said ironing machine 10, all of which is detrimental to the optimum functionality and efficiency of said ironing machine 10.

Figure 2:
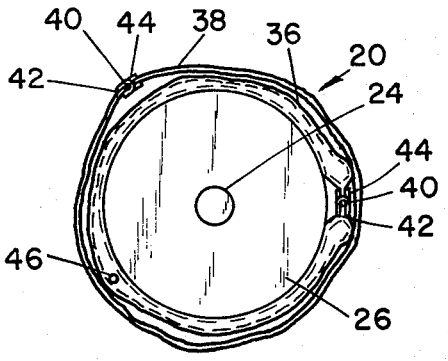
FIG. 2 is an enlarged end view of an industrial. ironing machine rotatable cylinder with a deflated pneumatic backup pad device and roll cover assembled thereto.

Referring to FIG. 2, to explain the construction and utilization of this invention, which contemplates providing both an impermeable pneumatic and flexible roll cover backup or cushion member 36 having opposite wall member as shown, as well as also an impermeable flexible roll cover member 38, said assembly provides a more resilient backup pad and steam vapor and condensate blocking means than has heretofore been available. A typical ironing cylinder or roll 20 is shown in FIG. 2, however, circumscribed about the longitudinal dimension of said cylinder or roll 20 is a deflated impermeable pneumatic roll cover backup member 36 as well as an impermeable roll cover member 38, the longitudinal ends of both said members 36 and 38 being connected together in cylindrical configuration about said roll drum by means of inserting a pin member 40 through the multiple, closely spaced gudgeon elements 42 of belt lacing knuckle members 44 affixed to the opposing longitudinal edges of each of said members 36 and 38. Then, by means of the valve 46, said pneumatic roll cover backup member 36 is inflated with air or any other suitable medium in order to inflatably distend the sides thereof radially inward, in frictional engagement and retainment with said roll drum 26, and radially outward to frictionally engage and retain said impermeable roll cover member 38, all of which is shown in FIG. 3.

Figure 3:
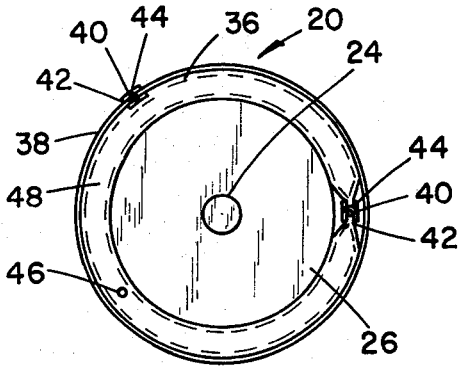
FIG. 3 is a view similar to FIG. 2, but showing the pneumatic backup pad device in an inflated state which is the operative arrangement thereof.

As also can be seen in FIG. 3, the air-gap 48 acts as an insulator to prevent excess radiant, convective, and conductive heat losses from steam chest chambers 18 during the ironing process, in addition to providing an impermeable steam barrier, thereby protecting said roll drum 26 from the corrosive effects of steam vapor condensate and the entrained chemical contaminants contained therein as earlier explained, and further providing a backup member having the resiliency to absorb work piece 32 thickness irregularities such as seams and buttons without damaging said work piece 32 or the steam chest apron 34. The inflatable roll cover backup member 36 and roll cover member 38 may be fabricated from any suitable heat-resistant rubberized fabric, rubber, plastic, or any other materials, or a suitable combination thereof.

Figure 4:
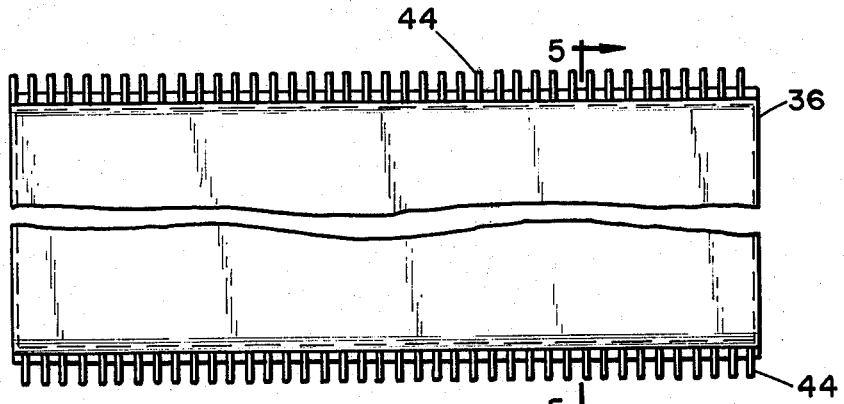
FIG. 4 is a plan view of a pneumatic backup pad device broken midway to foreshorten the view.
Figure 5:
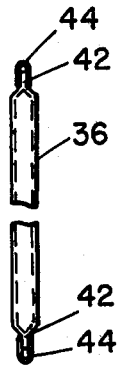
FIG. 5 is a cross sectional view of the pneumatic backup pad device shown in FIG. 4, as seen on the line 5—5 thereof and broken midway to foreshorten the view.

The foreshortened view seen in FIG. 5 is a crosssection taken along the line 5—5 of FIG. 4, showing the airtight seals joining the longitudinal edges of said pneumatic roll cover backup member 36, as well as the attached belt lacing knuckle members 44, whereby insertion of an elongated pin member 40 through the gudgeon elements 42 of said knuckle members 44, as shown and illustrated in FIGS. 2 and 3, enables the longitudinal circumferential assembly of said pneumatic roll cover backup member 36 about the roll drum 26, which means of assembly precludes the necessity for drilling and tapping screw holes in said roll drum 26 as is necessary in order to affix a roll cover backup pad member 28 thereto by present means. The absence of screw holes in the face of said drum 26 eliminates what would otherwise be additional points where vapor condensate corrosion could occur, and further eliminates the possibility of vapor condensate corrosion of the interior surface of said drum 26.

Figure 6:
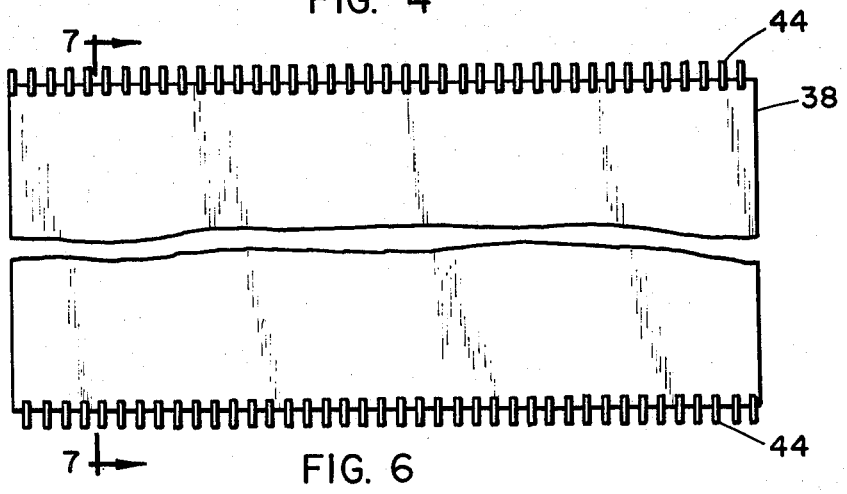
FIG. 6 is a plan view of a roll cover broken midway to foreshorten the view.

The foreshortened view seen in FIG. 6 is similar to the view seen in FIG. 4, but, however, showing the impermeable roll cover member 38 in a flat, unassembled state wherein also there is more particularly shown the belt-lacing knuckle members 44 affixed along both of the longitudinal edges of said roll cover member 38.

Figure 7:
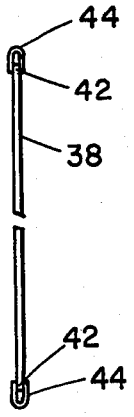
FIG. 7 is a cross sectional view of the roll cover shown in FIG. 6, as seen on the line 7—7 thereof, broken midway to foreshorten the view.

The view seen in FIG. 7 is a cross section taken along the line 7—7 of FIG. 6, showing the attached belt lacing knuckle members 44 whereby the insertion of a pin member 40 therethrough, as earlier explained, completes the longitudinal circumferential assembly of said roll cover member 38 about the pneumatic roll cover backup member 36

Figure 8:
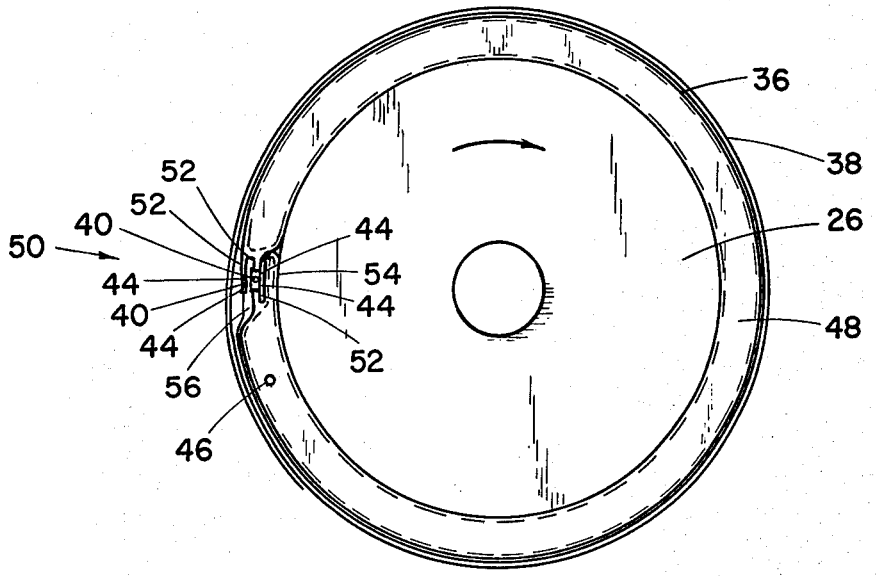
FIG. 8 is an enlarged end view of an additional embodiment of industrial ironing machine rotatable cylinder showing yet another assembled pneumatic backup pad device in an inflated operative state with a roll cover, which device incorporates connection means for the ends of the pad and cover which are different from that as illustrated in the foregoing embodiment.
Figure 9:
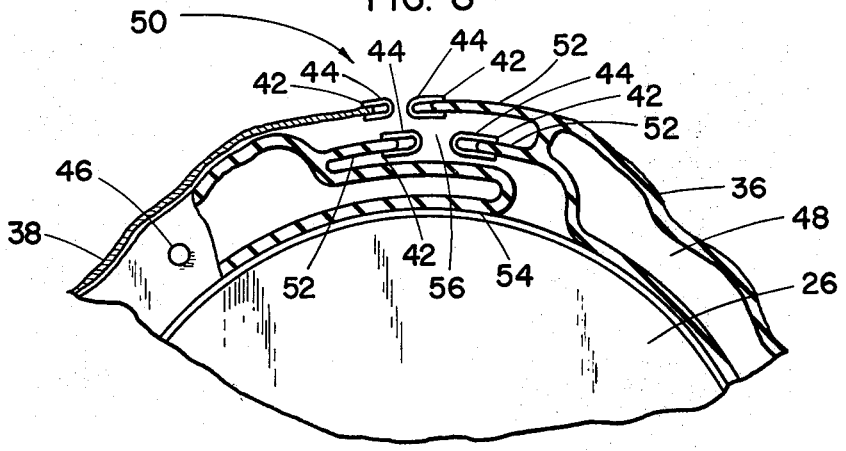
FIG. 9 is an enlarged end view of the connection means for the ends of the pneumatic backup pad illustrated in FIG. 8, fragmentarily showing said pad in a deflated state prior to connecting the ends for installation thereof upon an industrial ironing machine or roll.
Figure 10:
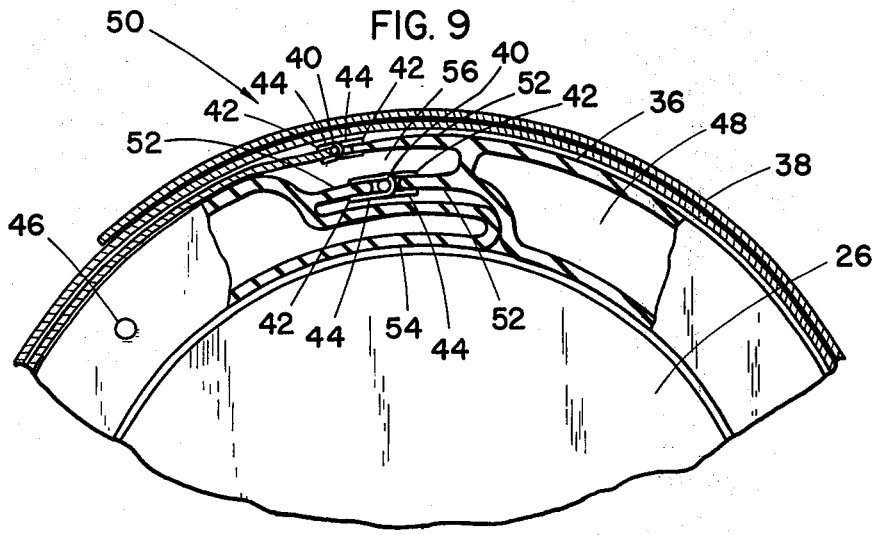
FIG. 10 is an enlarged end view of the pneumatic backup pad and connection means as illustrated in FIG. 8, fragmenatrily showing said pad in an inflated operative condition.

An additional embodiment of the instant invention, comprising the combination of an impermeable pneumatic pad comprising a roll cover back up member 36 and an impermeable roll cover member 38, respectively are illustrated in FIGS. 8–10, which embodiment shows a modified connection assembly 50 that provides additional improvement features as hereinafter described.

One of the problems which may be encountered in the employment of a rotatable cylinder industrial ironing machine, wherein the cylinder members thereof respectively have a roll cover backup pad and roll cover affixed thereto, is that the roll cover backup pad and roll cover connection means sometimes causes a resultant protrusion either inward or outward of the cylinder cover assembly, which protrusion frequently results in otherwise unnecessary wear and damage to the cylinder face, in the case of an inward protrusion, or in the case of an outward protrusion, results in excess wear and damage to the steam chest apron as well as the steam chests, in addition to impressing undesirable marks upon work pieces during the ironing operation, breaking buttons on garment work pieces, and other harmful effects. The modified connection assembly 50 herein described provides a means to overcome the otherwise undesirable consequences resultant from either an inward or outward protusion in the cylinder cover assembly which result from the connection means thereof.

The modified connection assembly 50 is assembled generally as previously described, i.e., the respective ends of the pneumatic roll cover backup member 36, and, in the modified connection assembly embodiment, one end of the roll cover member 38, are installed circumferentially around the longitudinal dimension of an ironing machine roll drum 26, when said pneumatic roll cover backup member 36 is in a deflated state, by means of inserting pin members 40 through respective intermeshed knuckle members 44 of closely spaced belt-lacing gudgeon elements 42 respectively affixed to integrally formed non-pneumatic connection extensions 52 on said backup pad member 36, as respectively illustrated in FIGS. 8–10.

It will be noted that the modified connection assembly members are generally internal of the lateral dimension of the pneumatic roll cover backup member 36 when said backup member is in the inflated operational state. It will be further noted that a pneumatic extension 54 provides a protective pneumatic cushion to prevent damage to the face of the cylinder drum 26 which might otherwise result should there be compressible contact of the belt lacing knuckle members 44 with the face of said drum 26 during ironing operations. It should be additionally noted that a deflection space 56 is provided for the roll cover connection belt-lacing knuckle members 44, as well as the fact that said roll cover 38 preferably is wrapped with multiple plies about the pneumatic roll cover backup member 36 in a direction opposite the direction of rotation of the ironing cylinder with the trailing edge of said roll cover 38 being free and held in place during operation by the counter-rotation effect of said ironing cylinder, thereby eliminating any outward cylinder cover assembly protrusion and the otherwise resultant harmful effects therefrom.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A pneumatic pad and roll cover assembly for use upon rotatable ironing cylinder members of an industrial ironing machine comprised of an initially substantially flat flexible pneumatic member having a pair of similar impermeable elastic walls and said pneumatic member also having opposite ends and a length and width adequate to substantially circumferentially and longitudinally envelope said ironing cylinder members, means to secure said opposite ends of said pneumatic member together when extended around said cylinder, a flexible substantially inelastic cover member having opposite ends and substantially circumferentially and longitudinally enveloping said pneumatic member when extended about an ironing cylinder, and means to connect the opposite ends of said cover member in circumferential and longitudinal cylindrical envelopment about said pneumatic member when mounted upon said ironing cylinder to restrict the expansion of said pneumatic member to a pre-determined circumferential dimension, whereby when said pneumatic member is inflated with gas under a limited pressure said pneumatic member is elastically distended radially inward to compressively and frictionally engage the longitudinal outer circumference of said ironing cylinder member with one wall of said pneumatic member and said pneumatic member also is distended radially outward to frictionally engage the longitudinal circumferential cover member with the opposite wall of said pneumatic member, thereby being adapted to provide an ironing cylinder having a compressible and yieldable pressure surface throughout the entire circumference of said cylinder.

2. The pneumatic pad and roll cover assembly according to claim 1 in which said pneumatic member and said cover member comprise impervious steam vapor and steam condensate barrier surfaces to prevent steam vapor and steam condensate contacting said ironing cylinder members.

3. The pneumatic pad and roll cover assembly according to claim 1 in which the inflating gas medium employed to radially distend said pneumatic member provides an insulation barrier to reduce heat losses between the steam chest of an industrial ironing machine and said rotatable ironing cylinders.

4. The pneumatic pad and roll cover assembly according to claim 1 in which the resilient ironing cover member assembly provides a pliable contact surface capable of accommodating thickness variations in work pieces introduced for ironing through said rotatable cylinder industrial ironing machine.

5. The pneumatic pad and roll cover assembly according to claim 1 in which said pneumatic member has non-pneumatic extensions on the opposite ends thereof and said means to connect said ends of said pneumatic member are affixed to non-pneumatic extensions on said pneumatic member.

6. The pneumatic pad and roll cover assembly according to claim 5 in which said non-pneumatic extensions on said pneumatic member extend a limited distance longitudinally respectively from opposite longitudinal face edges of said pneumatic member.

7. The pneumatic pad and roll cover assembly according to claim 5 in which said means to connect said non-pneumatic extensions comprise a series of interfitting members respectively affixed to said extensions and means to secure said members in interfitting and flexible relationship.

8. The pneumatic pad and roll cover assembly according to claim 1 in which said pneumatic member has a pneumatic extension outward of one longitudinal face edge thereof, said pneumatic extension substantially forming an interior circumferential continuation of said pneumatic member and positioned to underlie said means to connect said ends of said pneumatic member when connected to an ironing cylinder, said pneumatic extension when inflated having thickness dimension substantially less than the inflated thickness of said pneumatic member.

9. The pneumatic pad and roll cover assembly according to claim 8 in which one end of said pneumatic member has another non-pneumatic extension thereon extending from the outer longitudinal face edge thereof when in operative position upon an ironing cylinder member, said non-pneumatic extension being exterior of said connection means, and means connected to said another extension to which one edge of a cover member may be affixed thereto.

* * * * *